US006123573A

United States Patent [19]

Savicki, Jr.

[11] Patent Number: 6,123,573

[45] Date of Patent: Sep. 26, 2000

[54] STRAIN RELIEF CLAMP ASSEMBLY

[75] Inventor: Gerald R. Savicki, Jr., Syracuse, N.Y.

[73] Assignee: Pass & Seymour, Inc., Syracuse, N.Y.

[21] Appl. No.: 09/357,470

[22] Filed: Jul. 20, 1999

[51] Int. Cl.[7] ..... H01R 13/58; H01R 4/30; H01R 4/36; H01R 4/38

[52] U.S. Cl. ..... 439/469; 439/466; 439/801; 439/810; 439/814; 439/815

[58] Field of Search ..... 439/466, 469, 439/472, 473, 468, 801, 810, 814, 815

[56] References Cited

U.S. PATENT DOCUMENTS 4,874,332 10/1989 Munroe .

5,021,006 6/1991 Fargeaud et al. ..... 439/469

5,041,013 8/1991 Greenbaum .

*Primary Examiner*—Paula Bradley

*Assistant Examiner*—Edwin A. Leon

*Attorney, Agent, or Firm*—Wall Marjama & Bilinski

[57] ABSTRACT

A strain relief assembly is readily adaptable to clamp electrical cords of various sizes and/or shapes. The assembly is provided with differently configured clamping surfaces that may accommodate a variety of cords without compromising the ability of the clamp assembly to secure the various cords, and a user of the assembly may easily select a desired clamping surface. The assembly includes a base clamp member with a clamping surface, a securing member that may also include a clamping surface, and an insert that includes a clamping surface.

16 Claims, 3 Drawing Sheets

STRAIN RELIEF CLAMP ASSEMBLY

FIELD OF THE INVENTION

This invention relates to a strain relief clamping assembly for an electrical wiring connection. The strain relief assembly is easily adaptable to accommodate electrical cords of varying shapes and sizes.

BACKGROUND OF THE INVENTION

Electrical codes dictate that certain electrical wiring connections employ a strain relief clamp, especially wiring connections intended for higher amperage applications. As an example of such a wiring connection, electrical plugs may be attached at the end of an electrical cord for appliances such as electrical clothes dryers, ovens or ranges, so that the appliance may be connected to an electrical source by inserting the plug in a receptacle outlet. More specifically, the electrical wires are encased in an outer protective, nonconductive covering to form the electrical cord. At one end of the cord, the wires are electrically connected to the plug assembly. In such cases, a strain relief clamp may be employed to secure the cord to the plug assembly. Therefore, if the electrical cord is pulled away from the plug due to physically moving the appliance away from the plug received in the receptacle outlet or bending the electrical cord near the connection to the plug, the strain relief clamp inhibits the cord and wires from becoming detached from the plug assembly or damaged from strain placed thereon. As another example, the wiring at the other end of the electrical cord may be connected to the appliance. A strain relief clamp may be employed at this connection to secure the cord and wires to the appliance. The provision of a strain relief clamp is especially important for higher amperage applications to prevent electrical shock or fires.

Strain relief clamps are available in various forms. As a first example, the clamp may be specifically sized and shaped to accommodate a corresponding, specific size and shape of electrical cord. This, however, requires manufacturing, and inventory at the retail level, of multiple, individual units adapted for the various individual cords. As another example, the clamp may have a standardized size and shape, intended to accommodate a variety of cords. This, however, may lead to a compromise in the ability of the clamp to secure cords of certain sizes or shapes.

Accordingly, a need exists for a strain relief clamp that is adaptable to a wide variety of electrical cords, including cords of varying shapes or sizes.

SUMMARY OF THE INVENTION

This invention provides a strain relief assembly that is easily adaptable to clamp electrical cords of various sizes and/or shapes. The assembly is provided with differently sized and/or shaped clamping surfaces that may accommodate a variety of cords without compromising the ability of the clamp assembly to secure the various cords, and a user of the assembly may easily select a desired clamping surface.

According to certain embodiments, the assembly comprises: a base clamp member comprising a clamping surface and a second clamp member comprising a clamping surface, the base and second clamp members being securable to one another; and an insert that is insertable into the second clamping member, the insert also comprising a clamping surface. When the insert is inserted in the second clamp member, an electrical cord is clamped between the base clamp member and the insert clamping surface. When the insert is not inserted in the securing member, an electrical cord is clamped between the base clamp member and the second clamp member clamping surface. According to various preferred embodiments, one of the base clamp member and the second clamp member is integrally formed with a body of an electrical plug. Additionally, the insert may include more than one clamping surface on different edges thereof. The various clamping surfaces of the second clamp member and the insert have different configurations adapted to accommodate differently sized electrical cords.

According to other embodiments, the assembly comprises: a base clamp member and a securing member that are securable to one another; and an insert having a first edge and an opposed second edge. The insert is insertable into the securing member such that the first edge is opposed to the base clamp member for clamping an electrical cord therebetween, and the insert is also insertable into the securing member such that the second edge is opposed to the base clamp member for clamping an electrical cord therebetween.

The first edge and second edge of the insert may have different configurations adapted to accommodate differently sized electrical cords. The first edge clamping surface, along with a clamping surface on the base clamp member, contacts an electrical cord when the insert is inserted in the securing member with its first edge opposed to the base clamp member. The second edge clamping surface, along with a clamping surface on the base clamp member, contacts an electrical cord when the insert is inserted in the securing member with its second edge opposed to the base clamp member. Additionally, the securing member may include a clamping surface for contacting the electrical cord when the securing member is secured to the base clamp member and the insert is removed from the securing member.

DETAILED DESCRIPTION OF THE PREFERRED EMBODIMENT

Figure 1:
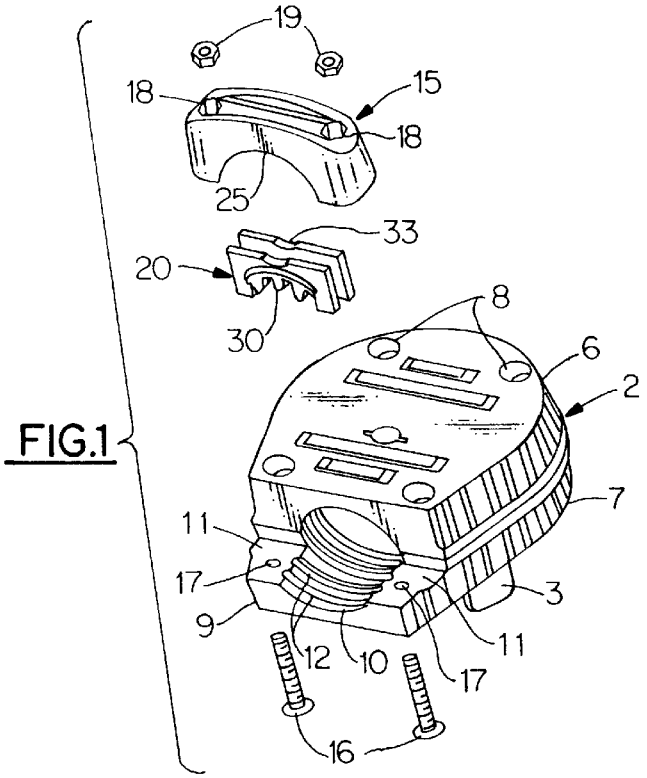
FIG. 1 is an exploded, perspective view of a strain relief clamp assembly according to a first embodiment.

A strain relief clamp assembly according to various embodiments of this invention is illustrated in FIGS. 1 to 4.

This embodiment includes electrical plug 2 that has prongs 3 (for example, three or four prongs) for connecting the plug to a receptacle, and the plug is adapted for electrical connection to wires encased in electrical cord 4. In the illustrated embodiment, plug 2 is composed of an upper section 6 and a lower section 7, these two sections being securable to one another, for example, by fasteners received in holes 8. Specifically, the ends of the wires encased in cord 4 may be electrically connected to the plug while section 6 is separated from section 7, and then the upper and lower sections 6 and 7 may be secured together. Plugs having this general configuration are known in the art. However, electrical codes dictate that electrical wiring connections for certain applications of such plugs employ a strain relief clamp, especially wiring connections intended for higher amperage applications. For example, for the described embodiment, a strain relief clamp may be required or desirable to prevent wires connected to plug 2 from being disconnected or damaged by strain placed on cord 4.

According to the described embodiment of the invention, plug 2 includes a first (or base) clamping member 9, integral with lower section 7. Member 9 includes a clamping surface 10 which, for the illustrated embodiment, has the form of a curved recess, containing raised parallel ridges 12, located between two essentially planar surfaces 11. A cord 4 in electrical connection with plug 2 is received on clamping surface 10, so that the cord is clamped between ridges 12 of clamping surface 10 and a cooperating clamping surface on a second clamping member.

More specifically, the second clamping member 15 is securable to first clamping member 9 to clamp cord 4 therebetween. In the illustrated embodiment, the first and second clamping members may be secured by fasteners 16, received in holes 17 on first clamping member 9 and corresponding holes 18 in second clamping member 15. Fasteners 16 may have the form of threaded bolts, with holes 17 and 18 having corresponding internal threads. Alternately, as illustrated in FIG. 1, the fasteners may have the form of threaded bolts, with complementary nuts 19 being non-circular (for example, hex-shaped) and holes 18 forming a non-circular recess (for example, similarly hex-shaped) in the top surface of member 15 to facilitate tightening of the bolts and nuts.

An advantage of this invention is that the strain relief clamp assembly is easily adaptable to cords of various sizes. In other words, a single assembly is provided with differently sized and/or shaped clamping surfaces that may accommodate a variety of cords without compromising the ability of the clamp assembly to secure cords of different sizes and/or shapes. This is accomplished by providing an insert 20 that is insertable into the second clamping member 15, whereby an installer of the electrical connection may select an orientation of the clamping assembly that best suits a specific electrical cord to be secured by the assembly.

Figure 2:
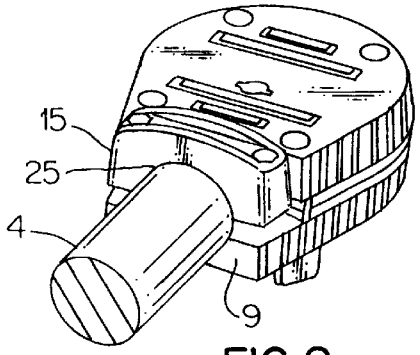
FIG. 2 is a perspective view of the assembly of FIG. 1 in a first orientation.

FIG. 2 illustrates a first orientation of the assembly. In this orientation, cord 4 has a relatively large thickness or diameter, for example, a round cord having a diameter of about 0.84 to 1.2 inches (or a flat cord having a similar thickness range). In this orientation, insert 20 has not been inserted into member 15, and surface 25 of the second clamping member serves as the clamping surface for cord 4. Accordingly, surface 25 has a predetermined size and shape especially adapted to clamp the relatively larger cord. In the illustrated embodiment, the clamping surface is formed by two opposing edges outer 26 and an intermediate edge 27 that each have similarly curved arcuate surfaces, these edges being visible in FIG. 6.

Figure 3:
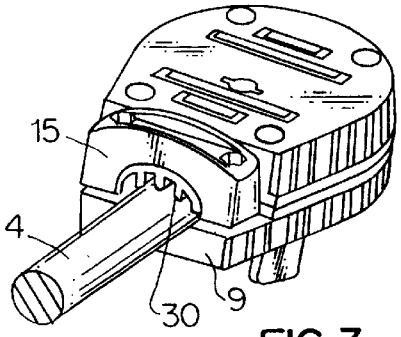
FIG. 3 is a perspective view of the assembly of FIG. 1 in a second orientation.
Figure 5:
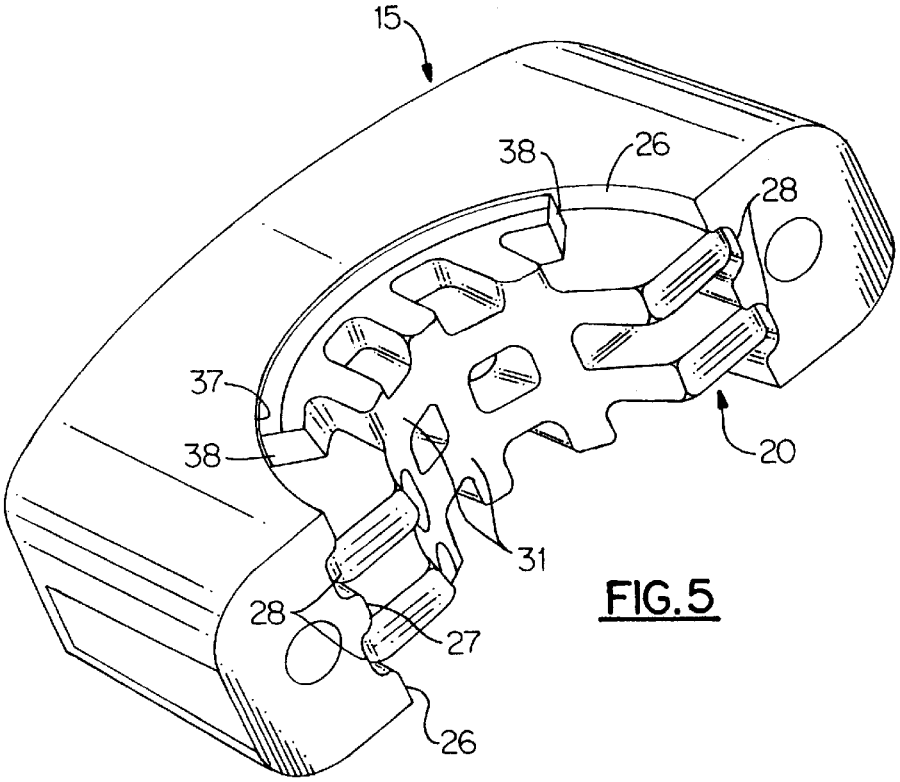
FIG. 5 is a perspective view of a securing member and insert in the second orientation of FIG. 3.
Figure 6:
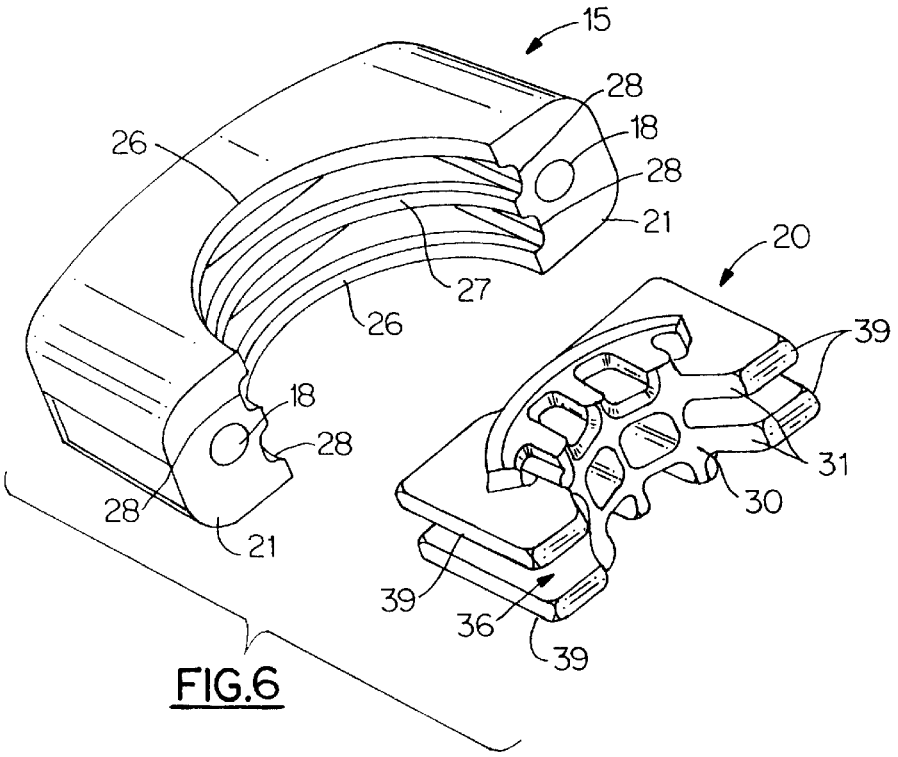
FIG. 6 is an exploded view of FIG. 5.

FIG. 3, and the partial views of FIGS. 5 and 6, illustrate a second orientation of the assembly, this orientation also being illustrated in the exploded view of FIG. 1. In this orientation, cord 4 has an intermediate thickness or diameter, for example, a round cord having a diameter of about 0.56 to 0.90 inches (or a flat cord having a similar thickness range). In this orientation, insert 20 has been inserted into member 15, with surface 30 of the insert serving as the clamping surface for cord 4. Accordingly, surface 30 has a predetermined size and shape, differing from surface 25, especially adapted to clamp the intermediately sized cord. In the illustrated embodiment, the clamping surface 30 is formed by two parallel arcuate edges 31 interconnected by transverse edges, which define a clamping surface having an arcuate surface with a radius less than that of surface 25.

Figure 4:
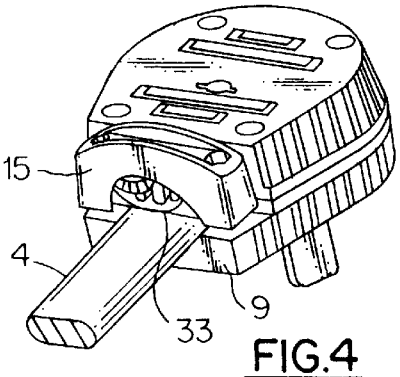
FIG. 4 is a perspective view of the assembly of FIG. 1 in a third orientation.
Figure 7:
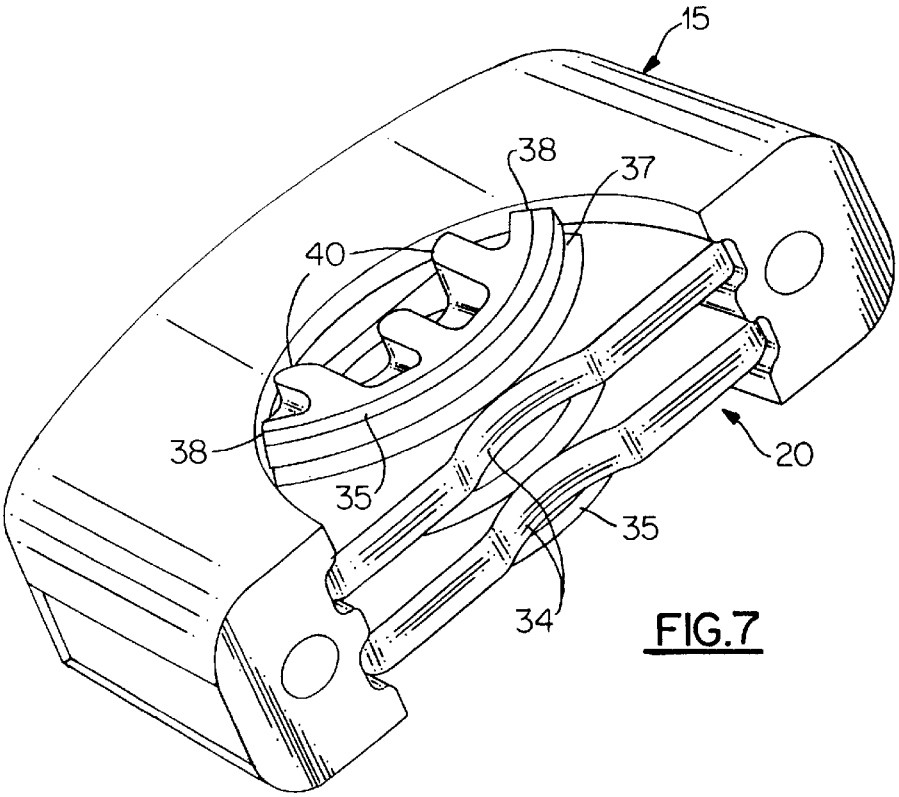
FIG. 7 is a perspective view of a securing member and insert in the third orientation of FIG. 4.
Figure 8:
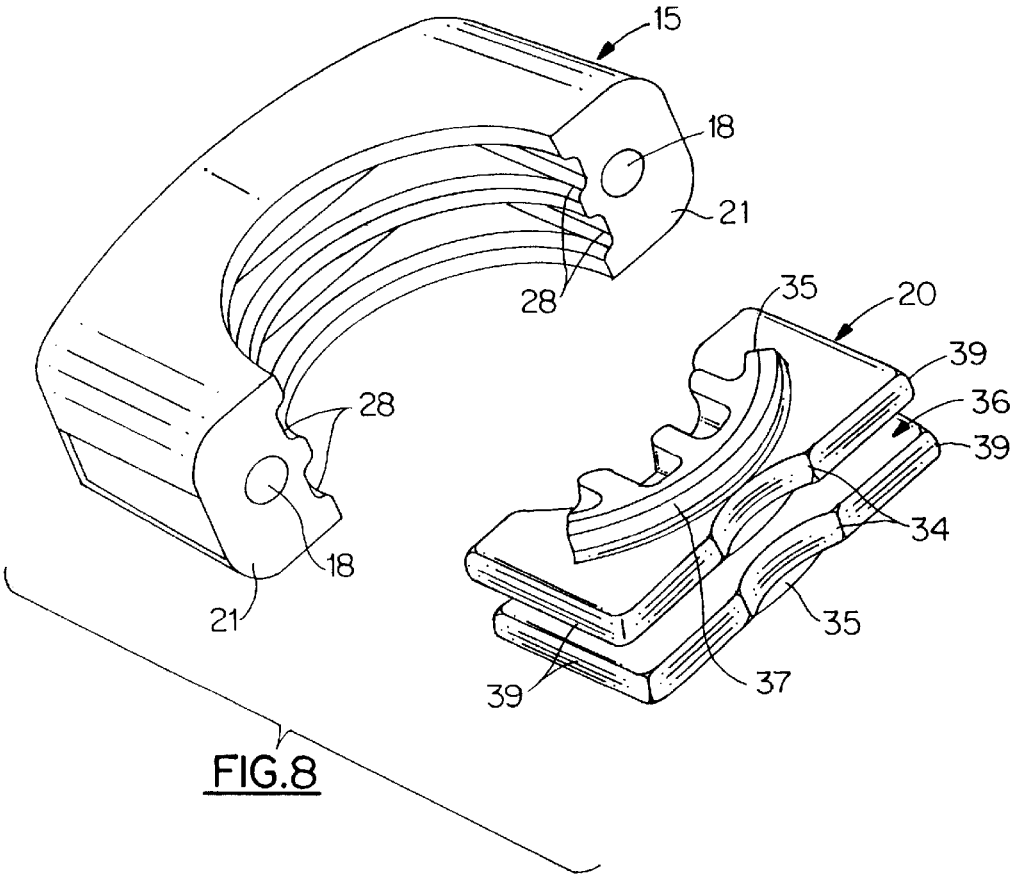
FIG. 8 is an exploded view of FIG. 7.

FIG. 4, and the partial views of FIGS. 7 and 8, illustrate a third orientation of the assembly. In this orientation, cord 4 has a relatively small thickness or diameter, for example, a flat cord having a thickness no greater than about 0.69 inches (or a round cord having a similar maximum diameter). In this orientation, insert 20 has been inserted into member 15, with surface 33 of the insert serving as the clamping surface for cord 4. Accordingly, surface 33 has a predetermined size and shape, differing from surface 25 and surface 30, and especially adapted to clamp the relatively smaller cord. In the illustrated embodiment, the clamping surface 33 is formed by two parallel edges 34 surface including arcuate recesses, these recesses having a radius less than that of surface 30.

In the orientations illustrated in FIGS. 3 and 4, member 15 serves to secure the insert 20 with respect to the base clamping member, and surface 25 does not contact cord 4. As shown in FIG. 5, the holes 18 are formed in two planar bottom surfaces 21 of securing member 15. These surfaces 21 face planar surfaces 11 of clamping member 9. When holes 18 are aligned with holes 17, the two members are secured together. Member 15 may have the form of a shell with an opening formed between surfaces 21 in which insert 20 is insertable. In the illustrated embodiment, outer edges 26 and intermediate edge 27 extend across to the sides of member 15, to form two opposed sets of side channels 28. Corresponding side edges 39 of insert 20 are slidingly received therebetween. Additionally, in both orientations shown in FIGS. 5 and 7, intermediate edge 27 of securing member 15 is received within the gap 36 formed between the extensions of side edges 39, to further inhibit lateral displacement of the insert member 20 slidingly received in the securing member 15.

In the described embodiment, insert 20 also includes front and rear projections 35 that each have a convex, arcuate top surface 37. As seen in FIG. 5, surface 37 corresponds to the concave, arcuate surface of edges 26 of securing member 15. Accordingly, when the insert is slidingly received in the securing member in the orientation shown in FIG. 5, surface 37 contacts edge 26, and edge 26 serves as a stop to define the maximum degree in which the insert may be received in the securing member.

The arced projections 35 terminate to form end surfaces 38. Additionally, projections 35 include rib-like extensions that terminate to form end surfaces 40. When the insert is slidingly received in the securing member in the orientation shown in FIG. 7, end surfaces 38 and 40 contact edge 26, and again, edge 26 serves as a stop to define the maximum degree in which the insert may be received in the securing member.

The various components of the assembly may be made of a plastic material, such as a thermoplastic or thermosetting resin. An example of a suitable material is a polyamide such as various grades of nylon.

Figure 9:
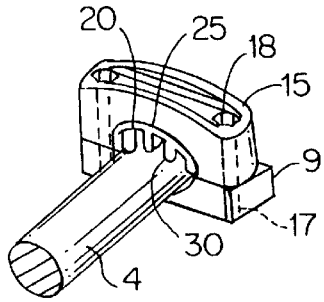
FIG. 9 is a perspective view of another embodiment of a strain relief clamp assembly.

The strain relief clamp assembly may be employed with wiring devices other than a plug of the type illustrated in FIGS. 1 to 4. FIG. 9 illustrates one alternate embodiment of the invention where base clamp member 9 is not integrally formed with an electrical plug or other wiring device. In this illustrated embodiment, the assembly may be secured to an electrical device, such as the back of an appliance. More specifically, fasteners received in apertures 17 and 18 secure the base clamp member 9 and the second clamp member 15 to one another, and they also may secure the assembly to the back of an appliance at a location adjacent to where wires in cord 4 are electrically connected to the appliance. Accordingly, the strain relief clamp assembly secures the cord and wires to the appliance, and prevents damage to the cord if strain is placed on the cord at this location, for example, from physically moving the appliance with the cord attached or from bending the cord. As for the embodiment illustrated in FIGS. 1 to 4, member 15 may include a clamping surface 25, adapted to accommodate larger sized cords when insert 20 is not inserted in member 15, and insert 20 may include two differently configured clamping surfaces for accommodating other sizes of cords, depending on which insert clamping surface is opposed to the base clamp member.

While the invention has been described with reference to preferred embodiments, it will be understood by those skilled in the art that various changes may be made and equivalents may be substituted for elements thereof without departing from the scope of the invention. In addition, many modifications may be made to adapt a particular situation of material to the teachings of the invention without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed:

1. A strain relief assembly comprising:

a base clamp member comprising a clamping surface and a second clamp member comprising a clamping surface, the base and second clamp members being securable to one another; and an insert that is insertable into the second clamping member, the insert comprising a clamping surface; and a second clamping surface, the second clamp member clamping surface, the first insert clamping surface, and the second insert clamping surface have different configurations adapted to accommodate differently sized electrical cords;

wherein when the insert is inserted in the second clamp member, an electrical cord is clamped between the base clamp member and the insert clamping surface, and when the insert is not inserted in the securing member, an electrical cord is clamped between the base clamp member and the second clamp member clamping surface.

2. A strain relief clamp assembly comprising:

a base clamp member and a securing member, the base clamp member and the securing member being securable to one another; and an insert comprising a first clamping surface and a second clamping surface, the insert being insertable into the securing member to assume a first orientation wherein the first clamping surface is opposed to the base clamp member for clamping an electrical cord therebetween, and the insert being insertable into the securing member to assume a second orientation different from the first orientation wherein the second clamping surface is opposed to the base clamp member for clamping an electrical cord therebetween.

3. The strain relief assembly of claim 2, wherein the base clamp member is integrally formed with an electrical plug.

4. The strain relief assembly of claim 2, wherein the first and second clamping surfaces of the insert have different configurations adapted to accommodate differently sized electrical cords.

5. The assembly of claim 2, wherein one of the base clamp member and second clamp member is securably attachable to a support adjacent a wiring connection.

6. The assembly of claim 2, wherein the securing member comprises a clamping surface for contacting the electrical cord when the securing member is secured to the base clamp member and the insert is removed from the securing member.

7. The assembly of claim 2, wherein the base clamp member comprises a recessed clamping surface that is adjacent two substantially planar surfaces.

8. The assembly of claim 2, wherein the base and securing members are secured together with a fastener.

9. The assembly of claim 8, wherein the securing member comprises two apertures therethrough, and the base clamp member comprises two cooperating apertures therethrough, and the assembly comprises fasteners for insertion in the two sets of apertures and securing the base and securing members together.

10. The assembly of claim 2, wherein the securing member comprises a shell, and the insert is slidably received in the shell.

11. The assembly of claim 10, wherein the insert is insertable through an opening in the shell.

12. The assembly of claim 11, wherein an interior of the shell includes opposed side grooves, and side edges of the insert are slidingly received in the grooves.

13. The assembly of claim 11, where the securing member includes a stop for limiting the degree to which the insert may be slidingly received in the shell.

14. The assembly of claim 2, wherein the base clamp member clamping surface includes parallel arcuate ridges.

15. The assembly of claim 2, wherein the first clamping surface of the insert includes parallel arcuate edges.

16. The assembly of claim 2, wherein the second clamping surface of the insert includes parallel edges with corresponding arcuate recesses therein.

* * * * *